US006379131B1

(12) United States Patent
Hoashi

(10) Patent No.: US 6,379,131 B1
(45) Date of Patent: Apr. 30, 2002

(54) SCROLL TYPE COMPRESSOR

(75) Inventor: Isao Hoashi, Ashikaga (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/513,138

(22) Filed: Feb. 25, 2000

(30) Foreign Application Priority Data

Mar. 4, 1999 (JP) ..... 11-056475

(51) Int. Cl.[7] ..... F04B 23/00; F01C 1/02
(52) U.S. Cl. ..... 417/440; 417/441; 418/55.1
(58) Field of Search ..... 417/410.5, 440, 417/441; 418/55.1, 55.4

(56) References Cited

U.S. PATENT DOCUMENTS

| | | | | |
|---|---|---|---|---|
| 4,432,708 A | | 2/1984 | Hiraga et al. | |
| 4,496,296 A | | 1/1985 | Arai et al. | |
| 4,642,034 A | | 2/1987 | Terauchi | |
| 4,717,314 A | | 1/1988 | Sato et al. | |
| 4,744,733 A | | 5/1988 | Terauchi et al. | |
| 4,904,164 A | | 2/1990 | Mabe et al. | |
| 4,940,395 A | | 7/1990 | Yamamoto et al. | |
| 4,940,396 A | * | 7/1990 | Shimizu et al. | 417/410.5 |
| 4,968,232 A | * | 11/1990 | Kikuchi | 418/55.5 |
| 5,240,388 A | | 8/1993 | Matsumoto et al. | 417/299 |
| 5,860,791 A | | 1/1999 | Kikuchi | |
| 6,056,523 A | * | 5/2000 | Won et al. | 418/55.1 |
| 6,234,769 B1 | * | 5/2001 | Sakai et al. | 417/410.5 |

FOREIGN PATENT DOCUMENTS

| | | | |
|---|---|---|---|
| DE | 3804418 | 10/1988 | 417/55.1 |
| EP | 0144169 | 6/1985 | |
| EP | 0297840 | 1/1989 | |
| JP | 60-101295 | 6/1985 | |
| JP | 62-091680 | 4/1987 | |
| JP | 63-212789 | 5/1988 | |
| JP | 01-106990 | 4/1989 | |
| JP | 03-018678 | 1/1991 | |
| JP | 10-115292 | 6/1998 | |

* cited by examiner

*Primary Examiner*—Charles G. Freay
(74) *Attorney, Agent, or Firm*—Baker Botts L.L.P.

(57) ABSTRACT

A scroll type compressor includes a fixed scroll member and an orbital scroll member disposed within a housing for defining a compression pocket compressing refrigerant gas, an open portion provided on the fixed scroll member at a position corresponding to an intermediate compression stage position of the compression pocket, and a mechanism for discharging refrigerant gas intermediately compressed in the compression pocket out of the compressor through the open portion. The refrigerant gas discharging mechanism includes a gas discharging path formed in the housing itself to communicate the open portion, without providing a particular member. The number of parts for forming a gas discharging route may be decreased, and the structure therefore may be simplified. The assembling ease of the compressor may be greatly improved. An excellent high-efficiency and low-load operation of the compressor may be achieved.

9 Claims, 5 Drawing Sheets

SCROLL TYPE COMPRESSOR

BACKGROUND OF THE INVENTION

1. Field of the Invention

The present invention relates to a scroll type compressor for compressing refrigerant gas, and, more specifically, relates to a scroll type compressor that is suitable for use in an air conditioner for vehicles and is capable of being driven at a high efficiency and a low load.

2. Description of Prior Art

A scroll type compressor being driven at a low load is disclosed, for example, in JP-A-10-115292. The main portion of this scroll type compressor is depicted in FIG. 6. In FIG. 6, fixed scroll member 11' and orbital scroll member 12' are assembled within housing 20' to define compression pocket 15' for compressing refrigerant gas. Fixed scroll member 11' has a first spiral element 11*a*' provided on a first end plate 11*b*', and orbital scroll member 12' has a second spiral element 12*a*' provided on a second end plate 12*b*'. First and second spiral elements 11*a*' and 12*a*' have substantially the same axial height and have spiral patterns that are different from each other. Fixed scroll member 11' and orbital scroll member 12' are assembled so that the first and second spiral elements interfit at an angular and radial offset to form a plurality of line contacts that define at least one pair of sealed off compression pockets. As compression pocket 15' moves inwardly, the refrigerant gas therein is compressed.

In the compressor, an open portion 16 is provided on fixed scroll member 11' at a position corresponding to an intermediate compression stage position of compression pocket 15'. A hole 20*a*' is defined on housing 20' at a position facing open portion 16. A pipe member 13 having a gas discharging path 17 therein and having a screw portion thereon is inserted into hole 20*a*'. Pipe member 13 is fixed to fixed scroll member 11' and housing 20' and sealed via seal rings 14*a* and 14*b*, such that gas discharging path 17 communicates open portion 16 and extends therefrom to the outside of the compressor. Seal rings 14*a* and 14*b* operate to prevent gas leakage when pipe member 13 is attached to fixed scroll member 11' and housing 20'.

In such a compressor, an opening/closing device (not shown) is provided in gas discharging path 17 of pipe member 13. The opening/closing device opens gas discharging path 17 to discharge gas from discharging path 17 to the outside of the compressor, for example, to the low pressure side of an external refrigerant circuit, when the load of the compressor is not higher than a predetermined value. Such a mechanism may enable a high-efficiency and low-load operation of the compressor. In a scroll type compressor, because a pair of compression pockets having the same compression stage are defined, the above-described mechanism is provided generally by two sets of gas discharge mechanisms.

In such a conventional mechanism for a scroll type compressor, however, two sets of gas discharging mechanisms are provided, and each mechanism includes pipe member 13 having gas discharging path 17, seal rings 14*a* and 14*b* and fixing and sealing structure therefor. In the mechanism, the number of parts may be great. Further, because the position of pipe member 13 depends on the position of fixed scroll member 11' assembled in housing 20', it is difficult to ensure its positional accuracy. Further, if seal rings 14*a* and 14*b* are improperly disposed into fixed scroll member 11' and housing 20', they may be deformed or cut, and a rattling may occur. To prevent such an inconvenience, seal rings 14*a* and 14*b* must be assembled very carefully, and skillfully.

SUMMARY OF THE INVENTION

Accordingly, it is an object of the present invention to provide an improved structure for a scroll type compressor that may decrease the number of parts, may have a good assembling ability, and may operate at a high efficiency and a low load.

To achieve the foregoing and other objects, a scroll type compressor according to the present invention is herein provided. The scroll type compressor includes a fixed scroll member and an orbital scroll member disposed within a housing for defining a compression pocket for compressing refrigerant gas, an open portion provided on the fixed scroll member at a position corresponding to an intermediate compression stage position of the compression pocket, and a mechanism for discharging refrigerant gas intermediately compressed in the compression pocket out of the compressor through the open portion. The refrigerant gas discharging mechanism comprises a gas discharging path formed in the housing itself to communicate the open portion.

In the scroll type compressor, a first space portion may be formed on the open portion of the fixed scroll member, and the first space portion communicates the gas discharging path of the housing. Alternatively, a second space portion may be formed on the gas discharging path of the housing, and the second space portion communicates the open portion of the fixed scroll member. Still alternatively, a third space portion may be formed on a contact portion of the fixed scroll member and the housing, and the third space portion communicates the open portion of the fixed scroll member and the gas discharging path of the housing.

Further, in the scroll type compressor, a pair of compression pockets each having an identical compression stage may be defined by the fixed scroll member and the orbital scroll member. The open portion may be provided at each position corresponding to an intermediate compression stage position of each compression pocket, and both open portions communicate each other via the first, second or third space portion described above.

The gas discharging path may be formed to extend in a direction across an axis of a shaft provided in the compressor for driving the orbital scroll member. In the scroll type compressor, a throttling mechanism may be further provided for adjusting an amount of refrigerant gas discharged from the gas discharging path. The refrigerant gas discharged and adjusted in amount may be sent to a gas introduction path connected to an inlet port of the compressor and introduced with a low pressure refrigerant gas.

In the scroll type compressor according to the present invention, the gas discharging path is formed in the housing itself instead of a conventional pipe member having a gas discharging path which is attached to a fixed scroll member and a housing via seal rings. Therefore, the number of parts for forming a gas discharging path may be greatly reduced. Moreover, because the gas discharging path is formed in the housing itself and another particular member is not necessary for forming the gas discharging path, the structure may be formed small and simple. When the gas discharging path is formed to extend in a direction across an axis of the shaft for driving the orbital scroll member, particularly the axial size of the compressor may be further decreased. In addition because the gas discharging path is defined in the housing without positioning a certain member, the gas discharging path may be easily formed at a proper and desired position with a high accuracy, thereby improving the assembling ease.

Further, when the first, second or third space portion is formed between the fixed scroll member and the housing, the respective compressed gas discharged through a pair of compression pockets may easily join via the space portion. The joined gas may be smoothly discharged through the gas discharging path. Consequently, an excellent scroll type compressor capable of operating at a high efficiency and a low load may be achieved.

Further, when the throttling mechanism for adjusting the amount of the discharged refrigerant gas is provided, the gas adjusted in amount may be sent to a gas introduction circuit with a low pressure. The amount of gas may be controlled depending the requirements, thereby achieving a more efficient operation of the compressor at a lower load.

Further objects, features, and advantages of the present invention will be understood from the following detailed description of preferred embodiments of the present invention with reference to the accompanying figures.

BRIEF DESCRIPTION OF THE DRAWINGS

An embodiment of the invention now is described with reference to the accompanying figures, which are given by way of example only, and are not intended to limit the present invention.

DETAILED DESCRIPTION OF PREFERRED EMBODIMENT

Figure 1:
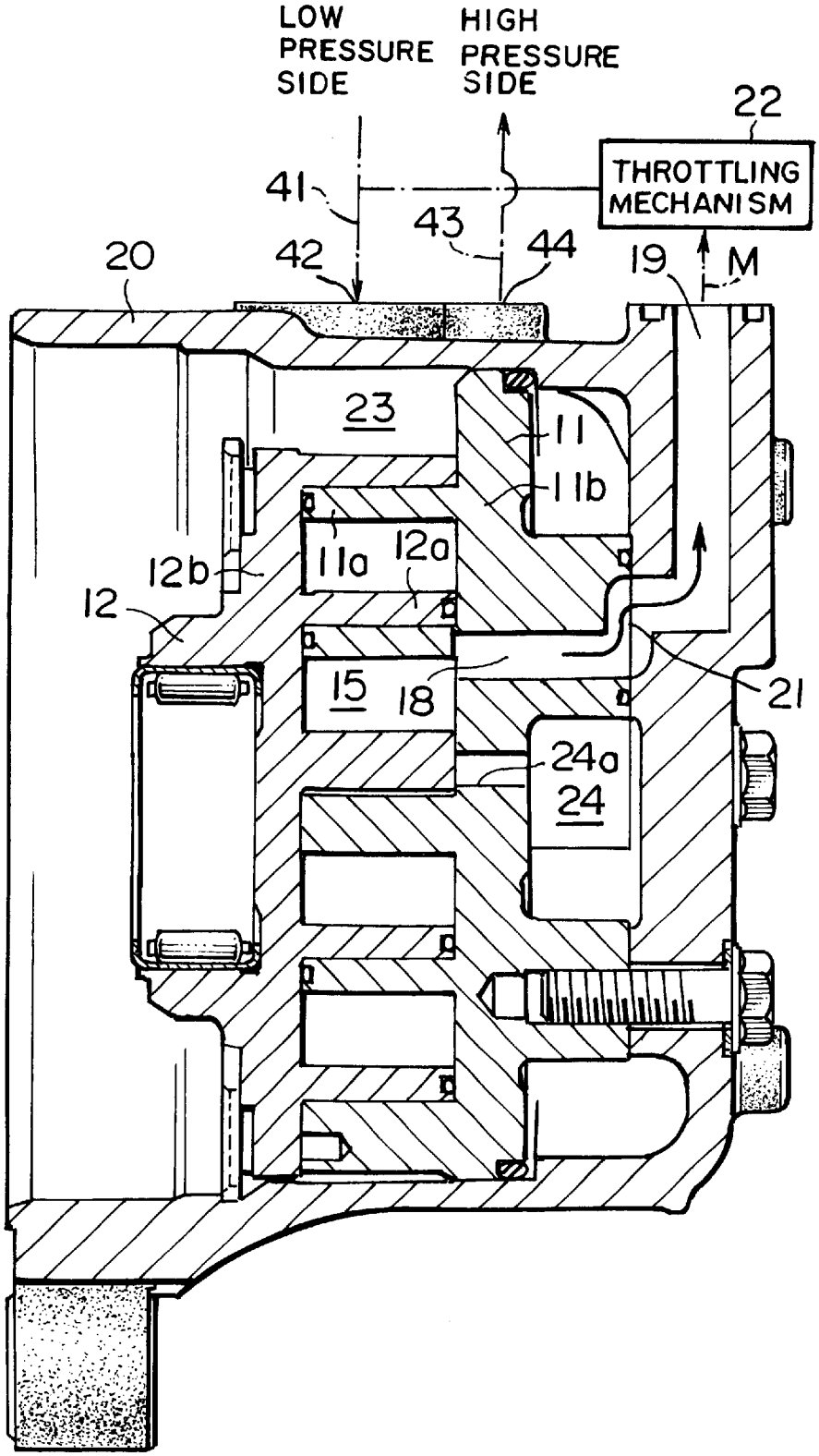
FIG. 1 is a vertical, cross-sectional view of a main portion of a scroll type compressor according to an embodiment of the present invention.

Referring to FIG. 1, a structure of a main portion of a scroll type compressor according to an embodiment of the present invention is provided. In FIG. 1, fixed scroll member 11 and orbital scroll member 12 are assembled within housing 20 to define compression pocket 15 compressing refrigerant gas. Fixed scroll member 11 has a first spiral element 11*a* provided on a first end plate 11*b*, and orbital scroll member 12 has a second spiral element 12*a* provided on a second end plate 12*b*. First and second spiral elements 11*a* and 12*a* have substantially the same axial height and have spiral patterns that are different from each other. Fixed scroll member 11 and orbital scroll member 12 are assembled so that the first and second spiral elements interfit at an angular and radial offset to make a plurality of line contacts which define at least one pair of sealed compression pockets 15. As compression pocket 15 moves inwardly, the refrigerant gas therein is compressed.

In the compressor, an open portion 18 is provided on fixed scroll member 11 at a position corresponding to an intermediate compression stage position of compression pocket 15. A gas discharging path 19 is formed in the rear wall of housing 20. Gas discharging path 19 discharges the intermediately compressed refrigerant gas from compression pocket 15 through open portion 18 toward the outside of the compressor. In this embodiment, gas discharging path 19 extends in a direction across an axis of a shaft for driving orbital scroll member 12, which is described in FIG. 5, below. A space portion 21 is formed on the contact portion of fixed scroll member 11 and housing 20 at a position between an end of open portion 18 and an end of gas discharging path 19. Space portion 21 communicates both of open portion 18 and gas discharging path 19.

FIG. 1 also depicts a refrigerant circuit near the compressor. A throttling mechanism 22 is provided outside of the compressor. Throttling mechanism 22 adjusts an amount of refrigerant gas discharged from gas discharging path 19 (shown by arrow M) by controlling the degree of opening. Namely, throttling mechanism 22 may control the amount of the discharged refrigerant gas at a variable condition. The refrigerant gas adjusted by throttling mechanism 22 is sent to a gas introduction path 41 connected to inlet port 42 and provided for introducing low pressure refrigerant gas into inlet port 42. The refrigerant gas is introduced into compression pocket 15 through suction chamber 23. The compressed gas is discharged into discharge chamber 24 through discharge port 24*a*, and the compressed gas is discharged into a high pressure side gas discharge path 43 through outlet port 44. When the refrigerant gas is compressed in compression pocket 15, a part of compressed gas is discharged to the outside of the compressor through open portion 18, space portion 21 and gas discharging path 19.

Figure 2:
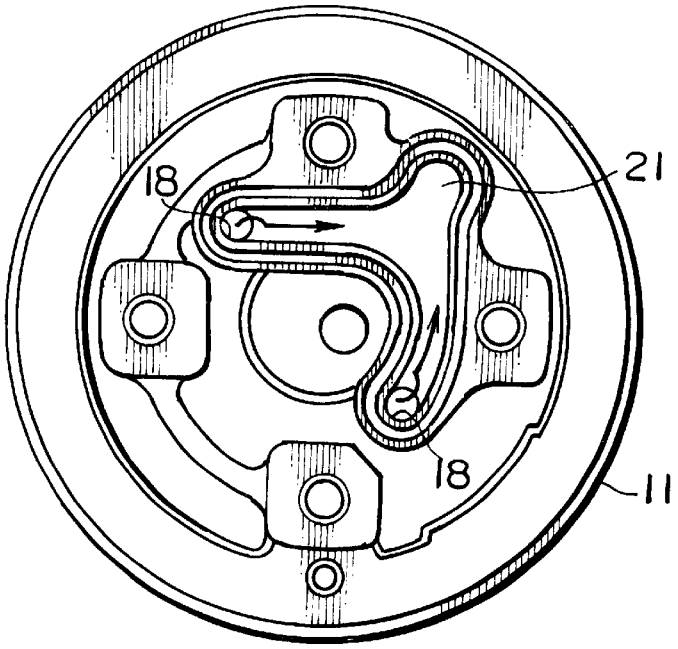
FIG. 2 is an elevational view of a back surface of a fixed scroll member of the compressor depicted in FIG. 1.

FIG. 2 depicts the configuration of the back surface of fixed scroll member 11. In this embodiment, a pair of compression pockets 15 having the same compression stage are defined, and a pair of open portions 18 corresponding respective compression pockets 15 are formed in fixed scroll member 11. Space portion 21 is formed as a forked shape and communicates both of the pair of open portions 18. The refrigerant gases discharged through respective open portions 18 join in space portion 21, as shown by arrows.

Figure 3:
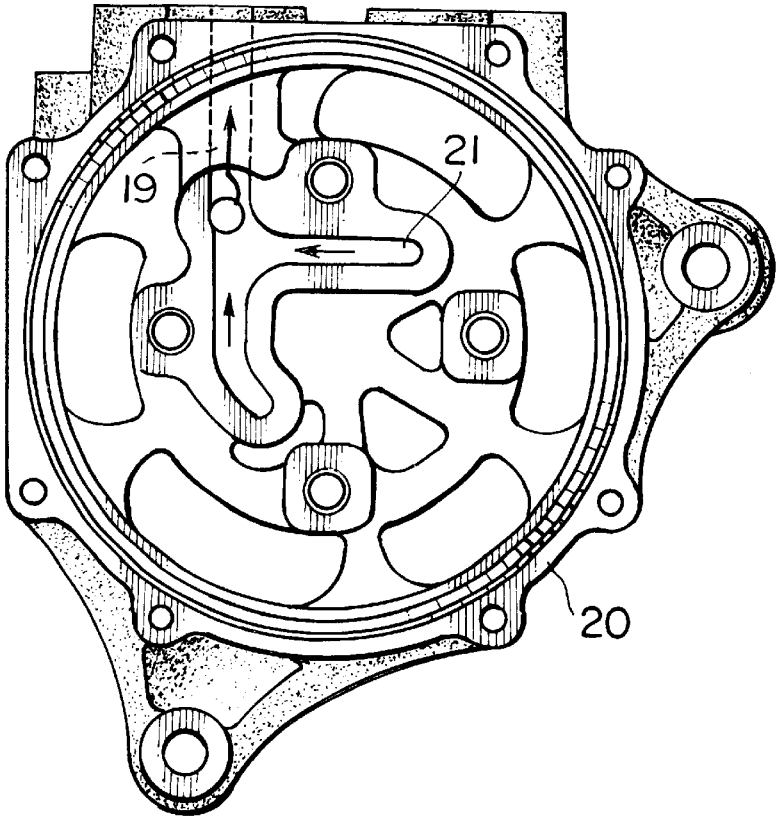
FIG. 3 is an elevational view of a housing of the compressor depicted in FIG. 1, as viewed from the fixed scroll member side.

FIG. 3 depicts the configuration of the inner surface of housing 20 facing the back surface of fixed scroll member 11. Space portion 21 is also formed as the same forked shape as that on the back surface of fixed scroll member 11. The refrigerant gases discharged through respective open portions 18 are gathered to the root portion of fork-shaped space portion 21, as shown by arrows, and flown into gas discharging path 19 therefrom.

In the scroll type compressor having such a structure, because the refrigerant gas intermediately compressed in compression pocket 15 is discharged from open portion 18 through gas discharging path 19 formed in housing 20 itself without providing a pipe member as in the conventional structure, the number of parts for forming a gas discharge route may be decreased. Moreover, the gas discharge route formed by using gas discharging path 19 is very simple. Therefore, the assembly of the compressor, specifically, the assembly of the structure for forming the gas discharge route may be greatly facilitated. Further, because gas discharging path 19 is formed integrally with housing 20, the position and the structure thereof may be very accurate. Space portion 21 serves to achieve a smooth gas flow. Because this space portion 21 is also formed integrally with fixed scroll member 11 and housing 20, it may be easily formed very accurately at an optimum position relative to open portions 18 and gas discharging path 19.

Although space portion 21 is provided at the contact portion of fixed scroll member 11 and housing in the above-described embodiment, a space portion may be formed only on fixed scroll member 11 at a position of an end of open portion 18 to communicate gas discharging path 19. Alternatively, a space portion may be formed only on housing 20 at a position of an end of gas discharging path 19 to communicate open portion 18.

Figure 4:
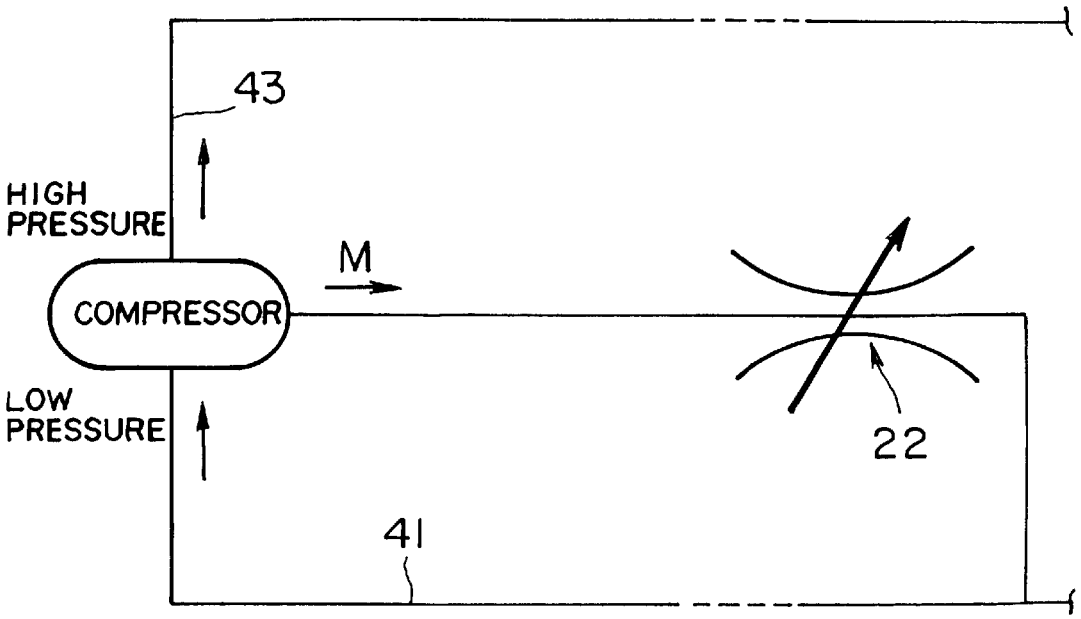
FIG. 4 is a schematic view of a part of a refrigerant circuit including the compressor depicted in FIG. 1.

In any case, in such a scroll type compressor having open portion 18 and gas discharging path 19, by providing an opening/closing mechanism for opening gas discharging path 19 when the load of the compressor is not higher than a predetermined value, the intermediately compressed refrigerant gas may be discharged from compression pocket 15 to the outside of the compressor through open portion 18 and gas discharging path 19, thereby performing a high-efficiency and low-load operation. When throttling mechanism 22 is provided instead of the opening/closing mechanism, the amount of the discharged gas may be adjusted more precisely. As depicted in FIG. 4, the opening degree of throttling mechanism 22 may be freely controlled, and the amount of the discharged refrigerant gas shown by arrow M may be controlled at an optimum value. The discharged gas controlled by throttling mechanism 22 may be sent to gas introduction path 41 with a low pressure. Thus, a higher-efficiency and lower-load operation of the compressor may be possible by appropriately controlling the flow rate of the discharged gas.

Figure 5:
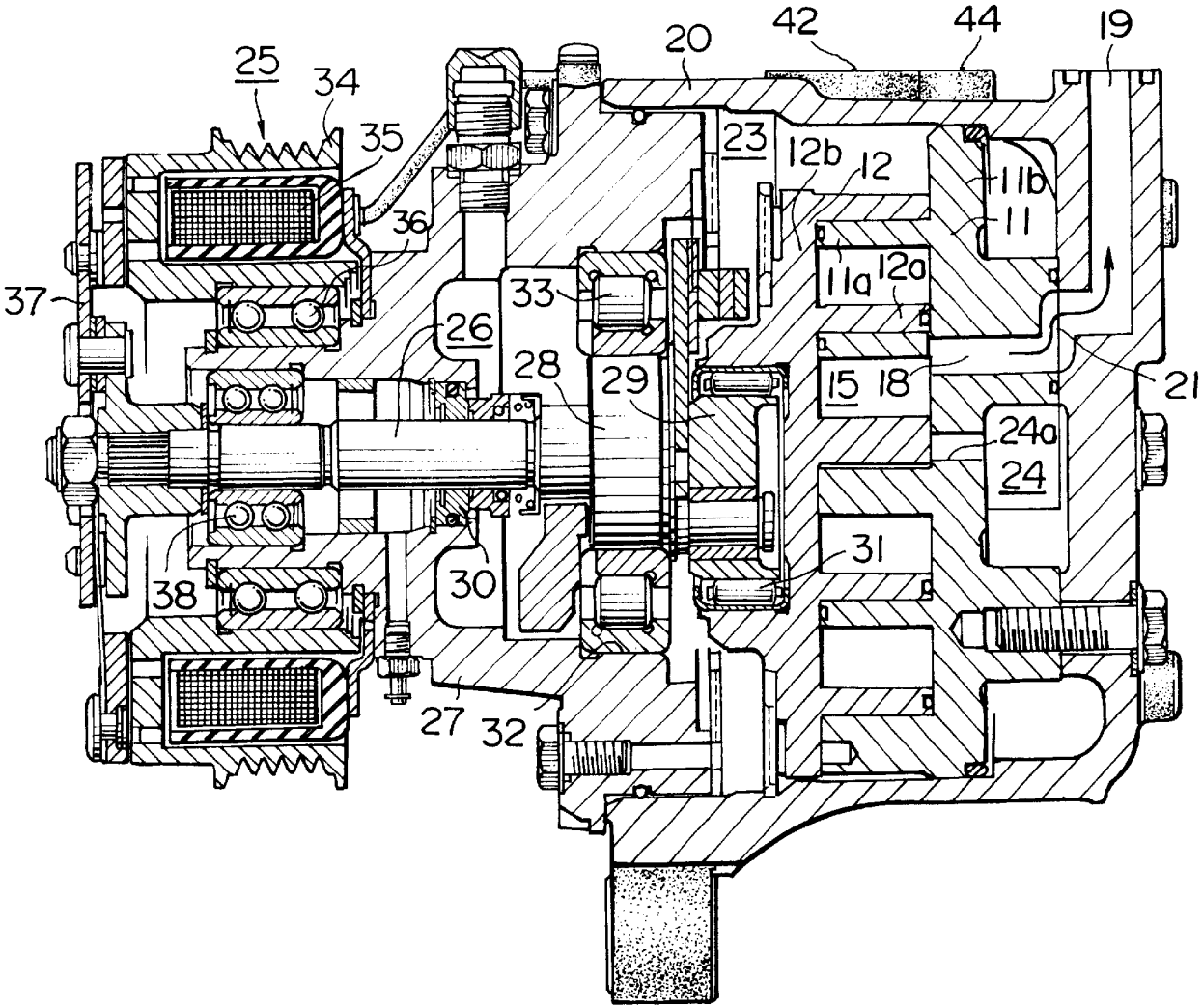
FIG. 5 is a vertical, cross-sectional view of the whole of the compressor depicted in FIG. 1.
Figure 6:
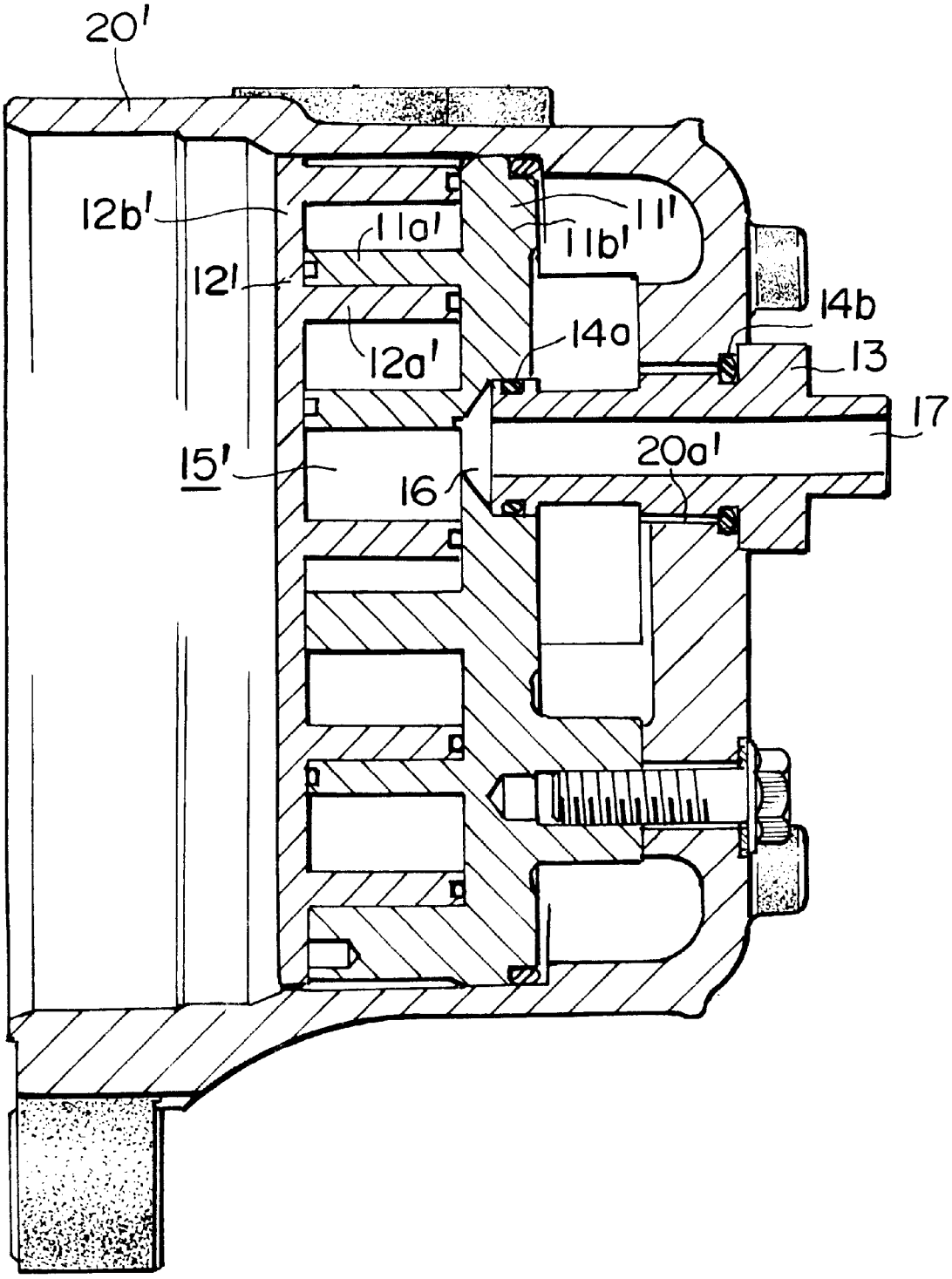
FIG. 6 PRIOR ART
FIG. 6 is a vertical, cross-sectional view of a main portion of a conventional scroll type compressor.

FIG. 5 depicts a vertical cross section of the compressor. In FIG. 5, front end plate 27 having through hole 32 is attached to the front side of housing 20. Shaft 26 for driving orbital scroll member 12 is inserted into through hole 32 of front end plate 27. Gas discharge path 19 is formed to extend in a direction across the axis of shaft 26. Large diameter portion 28 of shaft 26 is supported by radial bearing 33, and the other end portion thereof is supported by radial bearing 38. Eccentric bush 29 is attached to large diameter portion 28 of shaft 26, and eccentric bush 29 is connected to orbital scroll member 12 via radial bearing 31. Sealing mechanism 30 seals the portion between the outer surface of shaft 26 and the inner surface of through hole 32 of front end plate 27.

Electromagnetic clutch 25 is attached onto the end of front end plate 27 via radial bearing 36. Electromagnetic clutch 25 comprises rotor 34, armature 37, and electromagnetic solenoid 35. Rotor 34 is connected to an engine of a vehicle (not shown) via a belt (not shown). Armature 37 is disposed to face the end of rotor 34 at a clearance, and elastically connected to the end of shaft 26. When electromagnetic solenoid 35 operates, armature 37 is coupled to the end surface of rotor 34, and the power from an engine is transmitted from rotor 34 to shaft 26 through armature 37. Shaft 26 drives orbital scroll member 12 of the compressor.

In the scroll type compressor, by the orbital movement of orbital scroll member 12 driven by shaft 26, refrigerant gas is sucked from inlet port 42 to compression pockets 15 through suction chamber 23, the compressed refrigerant gas is discharged to the outside of the compressor through discharge port 24a and discharge chamber 24. In this compression operation, a part of the intermediately compressed gas is discharged to the outside of the compressor or throttling mechanism 22 through open portion 18, space portion 21 and gas discharging path 19, thereby achieving a high-efficiency and low-load operation of the compressor. A higher-efficiency and lower-load operation may be possible by controlling throttling mechanism (not shown). Because gas discharging path 19 is formed to extend in a direction across the axis of shaft 26, the axial size of the compressor may be designed small. However, the extending direction of gas discharging path 19 may be a direction along the axis of shaft 26.

Although only one embodiment of the present invention has been described in detail herein, the scope of the invention is not limited thereto. It will be appreciated by those skilled in the art that various modifications may be made without departing from the scope of the invention. Accordingly, the embodiment disclosed herein is only exemplary. It is to be understood that the scope of the invention is not to be limited thereby, but is to be determined by the claims which follow.

What is claimed is:

1. A scroll compressor comprising:

a fixed scroll member and an orbital scroll member disposed within a housing for defining a compression pocket compressing refrigerant gas;

an open portion provided on said fixed scroll member at a position disposed radially outward from a high pressure discharge sort of said fixed scroll, corresponding to an intermediate compression stage position of said compression pocket; and a mechanism for discharging refrigerant gas intermediately compressed in said compression pocket out of said compressor through said open portion, said refrigerant gas discharging mechanism comprising a gas discharging path formed in said housing to communicate said open portion.

2. The scroll type compressor of claim 1, further comprising: a first space portion formed on said open portion of said fixed scroll member, said first space portion communicating said gas discharging path of said housing.

3. The scroll type compressor of claim 1, further comprising: a second space portion formed on said gas discharging path of said housing, said second space portion communicating said open portion of said fixed scroll member.

4. The scroll type compressor of claim 1, further comprising: a third space portion formed on a contact portion of said fixed scroll member and said housing, said third space portion communicating said open portion of said fixed scroll member and said gas discharging path of said housing.

5. The scroll type compressor of claim 2, wherein a pair of compression pockets each having an identical compression stage are defined by said fixed scroll member and said orbital scroll member, said open portion is provided at each position corresponding to an intermediate compression stage position of each compression pocket, and both open portions communicate each other via said space portion.

6. The scroll type compressor of claim 3, wherein a pair of compression pockets each having an identical compression stage are defined by said fixed scroll member and said orbital scroll member, said open portion is provided at each position corresponding to an intermediate compression stage position of each compression pocket, and both open portions communicate each other via said space portion.

7. The scroll type compressor of claim 4, wherein a pair of compression pockets each having an identical compression stage are defined by said fixed scroll member and said orbital scroll member, said open portion is provided at each position corresponding to an intermediate compression stage position of each compression pocket, and both open portions communicate each other via said space portion.

8. The scroll type compressor of claim 1, wherein said gas discharging path is formed to extend in a direction across an axis of a shaft provided for driving said orbital scroll member.

9. The scroll type compressor of claim 1, further comprising: a throttling mechanism for adjusting an amount of refrigerant gas discharged from said gas discharging path, said refrigerant gas discharged and adjusted in amount being sent to a gas introduction path connected to an inlet port of said compressor.

* * * * *